US009090115B2

(12) United States Patent
Shields

(10) Patent No.: US 9,090,115 B2
(45) Date of Patent: Jul. 28, 2015

(54) MULTI-PANEL PAPERBOARD STRUCTURE

(71) Applicant: Rock-Tenn Shared Services, LLC, Norcross, GA (US)

(72) Inventor: Patrick A. Shields, Tucker, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 0 days.

(21) Appl. No.: 14/540,852

(22) Filed: Nov. 13, 2014

(65) Prior Publication Data

US 2015/0136642 A1 May 21, 2015

Related U.S. Application Data

(60) Provisional application No. 61/904,498, filed on Nov. 15, 2013.

(51) Int. Cl.

| | |
|---|---|
| ***B65D 85/50*** | (2006.01) |
| ***B42D 15/04*** | (2006.01) |
| ***B65D 5/42*** | (2006.01) |
| ***B65D 73/00*** | (2006.01) |

(52) U.S. Cl.

CPC ..... *B42D 15/045* (2013.01); *B65D 5/4233* (2013.01); *B65D 73/0078* (2013.01)

(58) Field of Classification Search

USPC ..... 206/232, 459.5, 767, 45.28, 472; 40/124.06, 124.09, 124.191

See application file for complete search history.

(56) References Cited

U.S. PATENT DOCUMENTS

| | | | | |
|---|---|---|---|---|
| 4,433,780 | A * | 2/1984 | Ellis | 206/232 |
| D319,843 | S | 9/1991 | Thornell | |
| 5,096,058 | A | 3/1992 | Juravin et al. | |
| 5,133,496 | A | 7/1992 | Davidson et al. | |
| 5,232,087 | A | 8/1993 | Schluger | |
| 5,407,076 | A | 4/1995 | Sabet | |
| 5,575,384 | A | 11/1996 | Saye | |
| D396,055 | S | 7/1998 | Ritchey | |
| 5,819,448 | A | 10/1998 | Kieves et al. | |
| 6,003,254 | A * | 12/1999 | Lorber | 40/124.06 |
| 6,550,617 | B1 | 4/2003 | Elva | |
| 6,732,459 | B1 * | 5/2004 | Clark | 40/124.06 |
| D493,829 | S | 8/2004 | Foster | |
| 7,222,446 | B2 | 5/2007 | Foster | |
| 7,975,411 | B2 | 7/2011 | Kershner et al. | |
| 2002/0162757 | A1 * | 11/2002 | Parsons | 206/232 |
| 2003/0208936 | A1 * | 11/2003 | Lee | 40/124.06 |
| 2007/0193079 | A1 | 8/2007 | Sepesy | |
| 2009/0031596 | A1 * | 2/2009 | Prpich | 40/124.06 |
| 2010/0223821 | A1 | 9/2010 | Bogal | |
| 2011/0126437 | A1 | 6/2011 | Bullington | |
| 2013/0213833 | A1 * | 8/2013 | Pruett | 206/223 |

FOREIGN PATENT DOCUMENTS

| | | |
|---|---|---|
| AU | 2007100722 | 9/2007 |
| GB | 2241470 | 9/1991 |

* cited by examiner

*Primary Examiner* — Jacob K Ackun

(74) *Attorney, Agent, or Firm* — Kilpatrick Townsend & Stockton LLP

(57) ABSTRACT

Disclosed herein is a paperboard structure designed to house a product, e.g. but not limited to a candy or chocolate bar, such that the combination forms a giftable paperboard structure. In this way, the paperboard structure serves as both a greeting card and as packaging for a gift, such as a candy bar or other product.

20 Claims, 4 Drawing Sheets

MULTI-PANEL PAPERBOARD STRUCTURE

CROSS REFERENCE TO RELATED APPLICATION

This application is related to and claims priority benefits from U.S. Provisional Application Ser. No. 61/904,498 ("the '498 application"), filed on Nov. 15, 2013, entitled MULTI-PANEL PAPERBOARD STRUCTURE. The '498 application is incorporated herein by reference.

FIELD

Embodiments of the invention relate to paperboard structures that assemble into giftable greeting cards.

BACKGROUND

Greeting cards are typically made of paperboard, but are not configured to readily accommodate a gift such as a candy bar or other product.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Disclosed is a paperboard structure that is designed to house a product, such as currency, an envelope, or a packaged food product (e.g., a candy or chocolate bar). The structure is configured so that a user may easily secure the product to the paperboard structure and create a giftable greeting card from the paperboard structure and product combination.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 5:
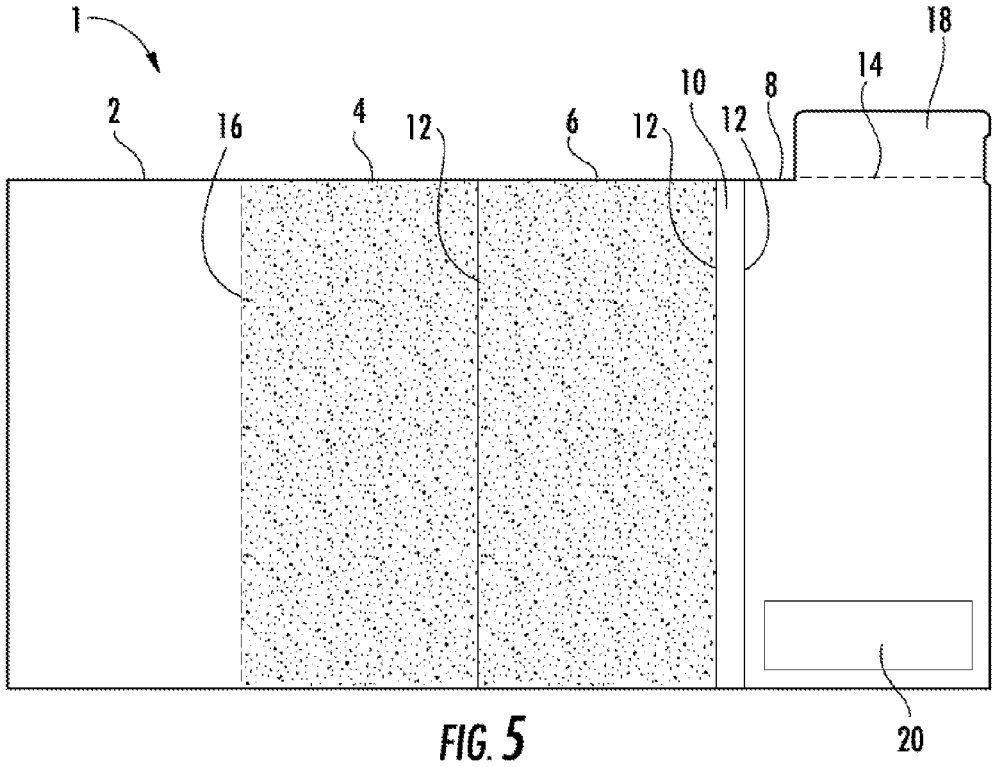
FIG. 5 shows a blank from which the paperboard structure of FIG. 1 is assembled.

Referring now to the drawings for a better understanding of the invention, FIG. 5 illustrates a single blank of foldable material 1. The blank illustrated herein is formed from foldable substrates, which may be paper-based material such as paperboard or corrugated sheet material, although other materials may be used if desired. The blank may be formed from virgin or recycled material, may be coated or uncoated, and may be single-ply or laminated paperboard.

As illustrated, blank 1 includes multiple adjacent panels: first panel 2, second panel 4, third panel 6, fourth panel 8, and spacer panel 10. In some embodiments, panels 2, 4, 6, and 8 are generally rectangular in shape, although the panels may have any suitable shape to form an assembled card structure having a desired shape. Spacer panel 10 is positioned between third panel 6 and fourth panel 8. In some embodiments, the width of spacer panel 10 generally corresponds to the thickness of the product 42 with which the assembled card structure will be used, although it need not. The product 42 may include packaging and/or a wrapper. The panels of blank 1 shown in FIG. 5 may be folded to create an assembled card structure 40, illustrated in FIGS. 1-4. As discussed in more detail below, the panels of blank 1 may be folded to construct an assembled card structure 40 with a first section 60 that includes a front face 22 and a rear face 24, an internal section 70 that includes a front face 26 and a rear face 28, and a second section 80 that includes a front face 30 and a rear face (not illustrated).

Fold lines 12 separate spacer panel 10 from panels 8 and 6, and separate panels 4 and 6. The term fold lines as used herein is not intended to be limiting, but is instead intended to include fold lines, score lines, perforation lines, and cut lines. In some embodiments, fold line 16 separates panel 2 from panel 6. In some embodiments, fold line 16 is a perforation line so that the internal section 70 (front face 26 and rear face 28) may be removed if desired. Blank 1 may optionally include a tab 18 that that may be connected to panel 8 by fold or perforation line 14.

As illustrated in FIG. 5, at least a portion of one or more of panels 4 and 6 includes a suitable adhesive so that panels 4 and 6 may be adhered together when blank 1 is assembled into card structure 40. Panel 8 may also include an area of adhesive 20. The area of adhesive 20 may be positioned anywhere along panel 8 and may have any suitable dimensions. In some cases, area of adhesive 20 is covered with a removable liner.

To erect blank 1 into assembled card structure 40, panels 4 and 6 are folded around fold line 12 and adhered to one another such that the first section 60 of the assembled card structure 40 has two layers. When assembled, the outer side of panel 6 (face down in FIG. 5) becomes the front face 22 of the first section 60 of the card structure 40. The outer side of panel 2 (face down in FIG. 5) forms the front face 26 of the internal section 70 and the outer side of panel 4 (face down in FIG. 5) forms a rear face 24 of the first section 60 of the assembled card structure. When assembled in a closed position, rear face 24 of the first section 60 and front face 26 of the internal section 70 oppose one another. The inner side of panel 2 (face up in FIG. 5) forms the rear face 28 of the internal section of the assembled card structure and the inner side of panel 8

(face up in FIG. 5) forms the front face 30 of the second section 80. When assembled in a closed position, rear face 28 of the internal section 70 and front face 30 of the second section 80 oppose one another. Various graphics (i.e., images and/or text) may be printed on front face 22, rear face 24, front face 26, and/or rear face 28 of the card structure 40 as desired. In some embodiments, spacer panel 10 acts as a spine of the assembled structure 40 and includes a forward portion 9 and a rear portion 11.

The first section 60 of the assembled structure 40 (including front face 22 and rear face 24) may be formed from two layers (panels 4 and 6) folded onto one another and includes an inner portion 23 and an outer portion 25. The inner portion 23 of at least one of the layers of the first section 60 of the assembled structure 40 is connected to a forward portion 9 of the spacer panel 10 and pivots about one or both of the fold lines 12 located adjacent to spacer panel 10. For example, the layer formed from panel 6 (front face 22 of the first section 60) is connected to a forward portion 9 of the spacer panel 10 (see FIG. 5). As shown in FIGS. 1-4, the assembled structure 40 may include an internal section 70 (including front face 26 and rear face 28) formed from panel 2, with the internal section 70 including an inner portion 27 and an outer portion 29. The inner portion of at least one of the layers of the first sections of the assembled structure 40 is connected to the front face 26 of the internal section 70. For example, the layer formed from panel 4 (rear face 24 of the first section 60) is connected to front face 26 of the internal section 70 (see FIG. 5).

The internal section 70 may be approximately the same size as the first section 60 (as shown in FIGS. 1-5) or may be smaller in width and/or height based on the configuration of panel 2. For example, blank 1 may be configured with a stepped configuration such that panel 2 does not extend along the full length of fold line 16 such that the assembled structure 40 includes a partial height internal section 70 allowing a user to view the second section 80 and/or the product 42 secured to the second section 80 (such as a candy bar 42) without pivoting the internal section 70. Because second panel 4 and third panel 6 have similar sizes, in the assembled structure 40, fold line 16 (about which the internal section 70 pivots) is located adjacent to or near spacer panel 10. One or more of faces 22, 24, 26, and 28 may be printed with graphics and text as desired, or left blank.

In some embodiments, the front face 30 of the second section 80 is formed from the fourth panel 8 and is connected to the rear portion 11 of spacer panel 10 such that the second section 80 may pivot about one or both of the fold lines 12 located adjacent to spacer panel 10. The front face 30 may include an inner portion 31 and an outer portion 32. The front face 30 may include one or more features configured to secure a product. For example, the rear face may include an adhesive area 20 for attaching to the product or an outer surface of the packaging or wrapper of a product. In some non-limiting embodiments, front face 30 may include an optional integral tab 18 configured to interface with the product (or the product's packaging) where the integral tab 18 is connected to front face 30 of second section 80 at fold line 14. The tab 18 may wrap around the product 42 or may be inserted into an opening in the packaging of the product 42.

Figure 1:
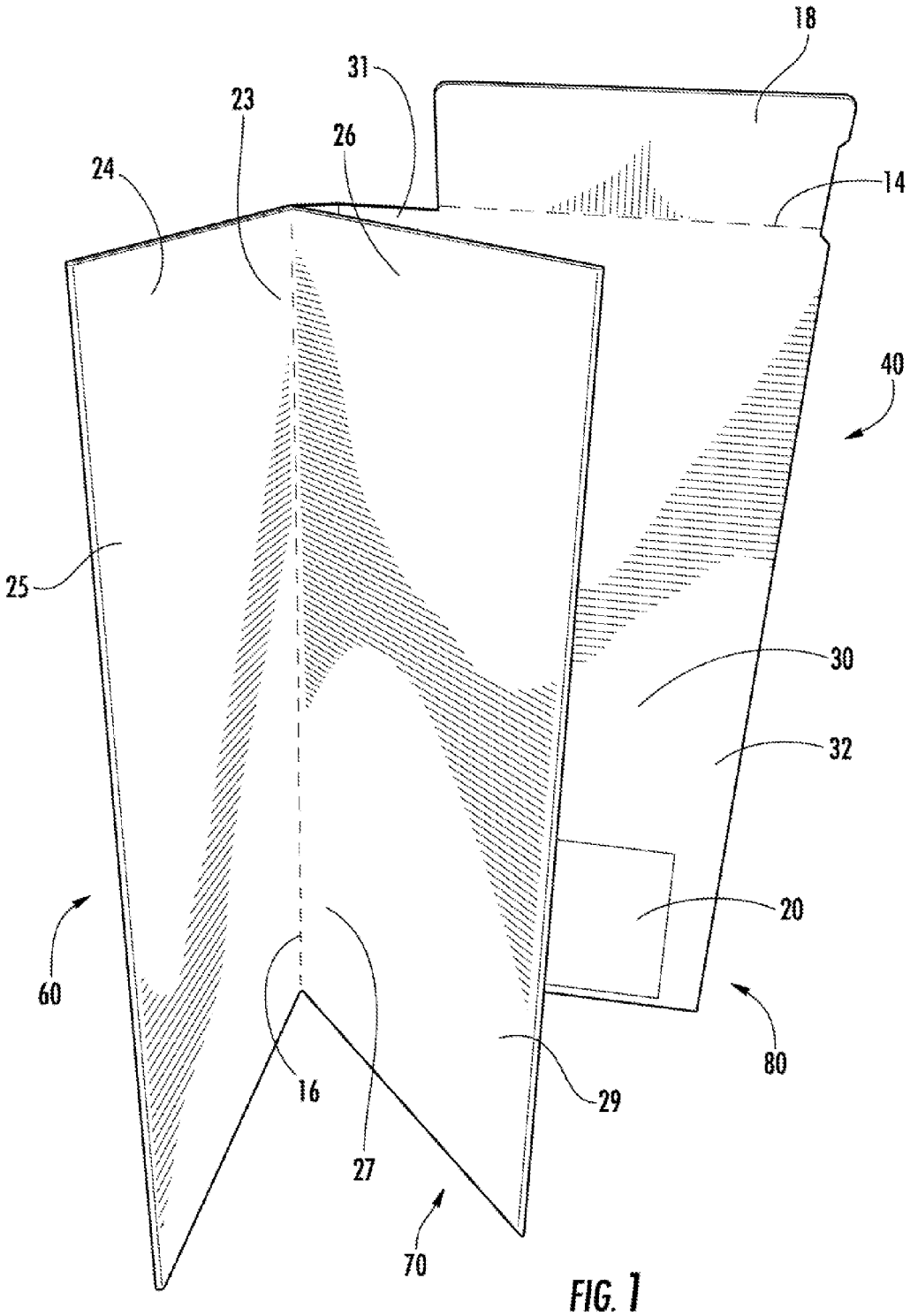
FIG. 1 is a perspective view of a paperboard structure according to one embodiment.
Figure 2:
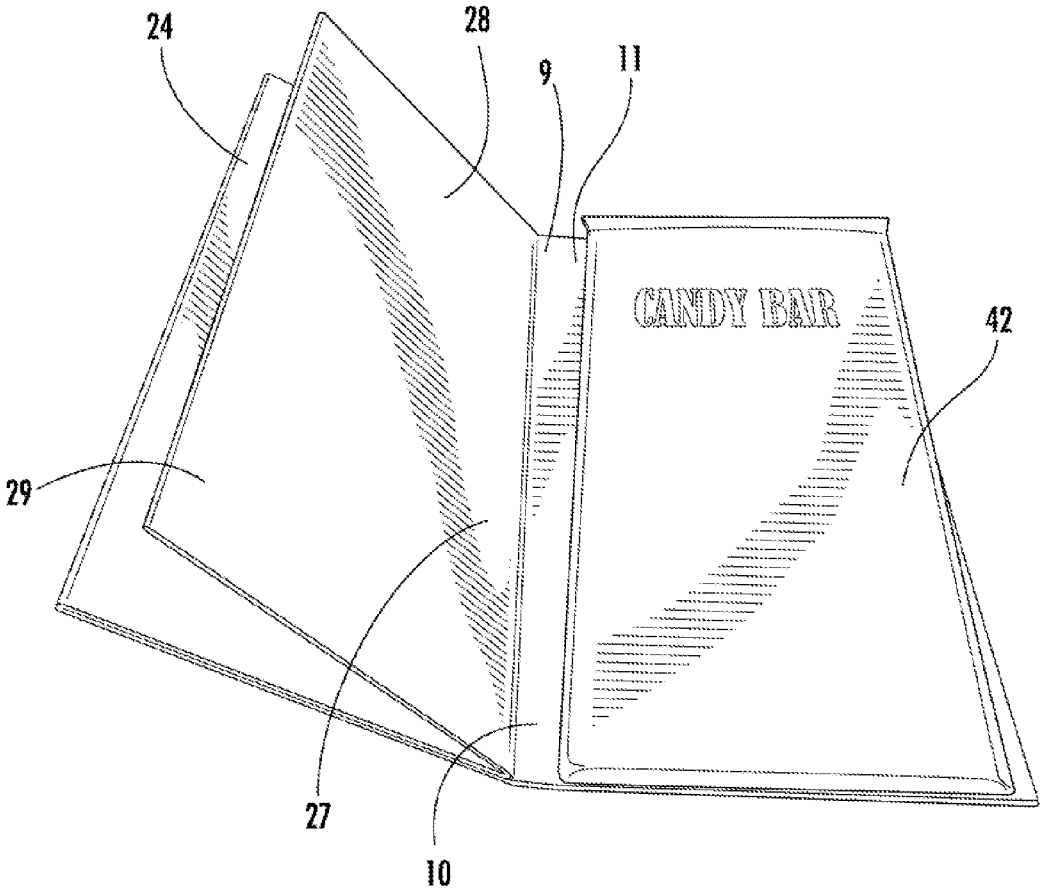
FIG. 2 is a perspective view of the paperboard structure of FIG. 1 assembled with a product and with the internal section pivoted toward the first section.
Figure 3:
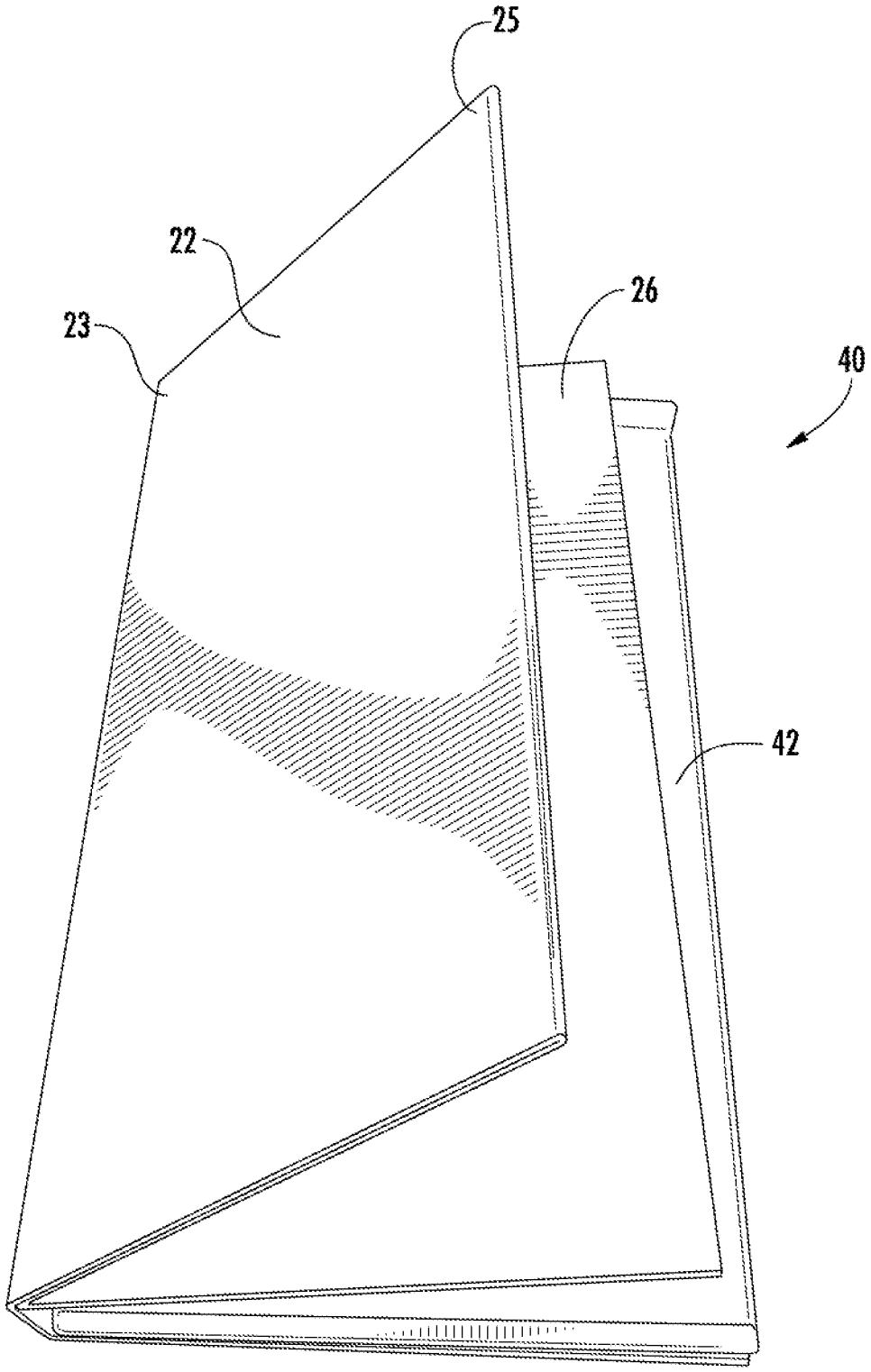
FIG. 3 is a perspective view of the paperboard structure of FIG. 1 assembled with a product and with the first section pivoted toward the second section.
Figure 4:
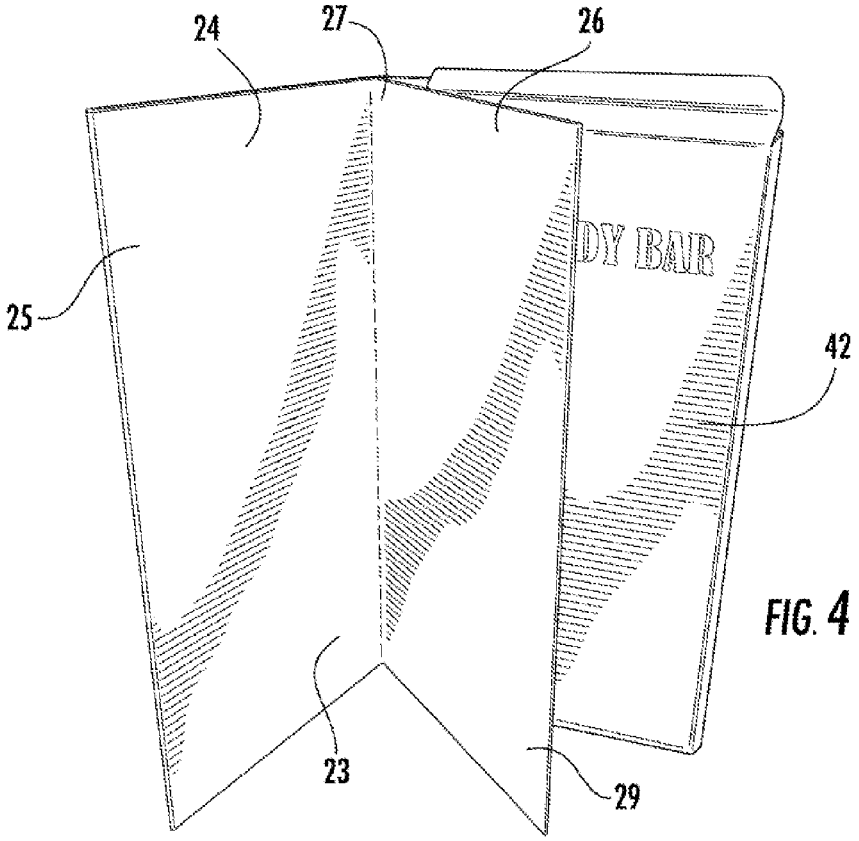
FIG. 4 is a perspective view of the paperboard structure of FIG. 1 assembled with a product and with the internal section pivoted toward the second section.

Assembled card structure 40 may be provided with (FIGS. 2-4) or without (FIG. 1) a product 42, such as candy bar 42. If offered without a product, a user may separately assemble a product (such as a candy bar 42) with the card structure 40. In particular, a user may remove any lining to expose the adhesive area 20 and adhere the product, such as candy bar 42, to the front face 30 (fourth panel 8) of second section 80 of assembled card structure 40. Tab 18 optionally may be used to further secure the product, such as candy bar 42, to the card structure 40 by wrapping the tab 18 around an end of the candy bar 42 and inserting the tab 18 into the top end of the carton associated with the candy bar 42. In some embodiments, the tab 18 is integral to the front face 30 (fourth panel 8) and may be operated independent of the other panels of the card structure 40 (i.e., regardless of the positions of the first section 60 or the internal section 70). When card structure 40 is erected and secured to product 42 such as candy bar 42, rear face 28 of panel 2 (not shown in FIG. 5) is adjacent to product 42, as shown in FIG. 2. The product 42, such as candy bar 42, is now easily and securely coupled to the paperboard structure to form a giftable greeting card. The paperboard structure serves as both a greeting card and as packaging for the product 42, such as the candy bar 42.

In some embodiments, a method for constructing the card structure 40 includes preparing a blank 1 that includes multiple adjacent panels: first panel 2, second panel 4, third panel 6, fourth panel 8 and spacer panel 10. Panels 4 and 6 may be folded against one another to form a first section 60 with two layers corresponding to panels 4 and 6. The two layers may be adhered to one another using glue, adhesive, or any other suitable method (such as staples or other mechanical fasteners). Once panels 4 and 6 are folded against one another, fold line 16 (located between panels 2 and 4) is disposed near or adjacent to forward portion 9 of spacer panel 10. Fold line 16 provides a pivoting location for panel 2, which functions as an internal section 70. Card structure 40 may be offered as assembled, without product. If offered in such a way, a consumer or other use may at a later time, secure any suitable product to the card structure 40. In particular, after pivoting the internal section 70 away from the second section 80, the removable liner may be removed from the area of adhesive 20 (see FIG. 5). Once the area of adhesive 20 is exposed, a product, such as product 42, may be pressed against the area of adhesive 20. To further secure the product 42, an optional integral tab 18 may be folded over fold line 14 and used to secure an upper portion of the product 42. For example, the integral tab 18 may (1) include adhesive to contact an outer surface of the packaging of the product 42, (2) may wrap around the packaging of the product 42, and/or (3) may be inserted into an opening in the packaging of the product 42.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A paperboard structure configured to secure a product, the paperboard structure comprising:

a first section with an outer portion and an inner portion, the first section comprising two layers of paperboard folded onto one another and secured together;

a spine with a forward portion adjacent a first of the two layers of the first section at the inner portion of the first section;

a second section adjacent a rear portion of the spine, the second section comprising an adhesive area; and an internal section disposed between the first section and the second section such that the internal section is configured to pivot about a fold line disposed adjacent to the spine.

2. The paperboard structure of claim 1, wherein the second section further comprises an integral tab.

3. The paperboard structure of claim 2, wherein the integral tab is attached to a portion of an upper edge of the second section and the integral tab is configured to interface with the product attached to the adhesive area.

4. The paperboard structure of claim 3, wherein a width of the integral tab is less than a total width of the second section.

5. The paperboard structure of claim 1, wherein the two layers of the first section are approximately the same size as one another and are adhered to one another.

6. The paperboard structure of claim 1, wherein a width of the spine approximately matches a thickness of the product.

7. The paperboard structure of claim 1, wherein an inner portion of the internal section is adjacent the inner portion of the first section along a second of the two layers of the first section.

8. The paperboard structure of claim 1, wherein at least one of the first section, the second section, and the internal section have graphics printed thereon.

9. The paperboard structure of claim 1, wherein the product is a candy bar and a wrapper of the candy bar is adhered to the adhesive area.

10. The paperboard structure of claim 1, wherein the fold line connects an inner portion of the internal section with the inner portion of the first section and wherein the fold line is perforated.

11. The paperboard structure of claim 1, wherein the internal section is smaller than the second section in at least one dimension.

12. A paperboard structure configured to secure a product, the paperboard structure comprising:

a first section with an outer portion and an inner portion, the first section comprising two layers of paperboard folded onto one another;

a spine with a forward portion connected to a first of the two layers of the first section at the inner portion of the first section;

a second section connected to a rear portion of the spine, the second section comprising an adhesive area and an integral tab disposed at an edge of the second section; and an internal section connected to a second of the two layers of the first section at the inner portion of the first section such that the internal section is disposed between the first section and the second section and the internal section is configured to pivot about a fold line disposed adjacent to the spine, wherein the paperboard structure is formed from a single piece of paperboard.

13. The paperboard structure of claim 12, wherein the two layers of the first section are approximately the same size as one another and are adhered to one another.

14. The paperboard structure of claim 12, wherein the product is a candy bar and a wrapper of the candy bar is adhered to the adhesive area.

15. The paperboard structure of claim 12, wherein a width of the spine is substantially the same as a thickness of the product.

16. The paperboard structure of claim 12, wherein at least one of the first section, the second section, and the internal section have graphics printed thereon.

17. The paperboard structure of claim 12, wherein the fold line connects an inner portion of the internal section with the inner portion of the first section and wherein the fold line is perforated.

18. The paperboard structure of claim 12, wherein the internal section is smaller than the second section in at least one dimension.

19. A paperboard structure comprising:

a first section with an outer portion and an inner portion, the first section comprising two layers of paperboard folded onto one another;

a spine with a forward portion connected to a first of the two layers of the first section at the inner portion of the first section;

a second section connected to a rear portion of the spine, the second section comprising an adhesive area and an integral tab disposed at an edge of the second section;

an internal section connected to a second of the two layers of the first section at the inner portion of the first section such that the internal section is disposed between the first section and the second section and the internal section is configured to pivot about a fold line disposed adjacent to the spine; and a product secured to the second section along the adhesive area, wherein the integral tab secures an upper portion of the product.

20. The paperboard structure of claim 19, wherein the integral tab is configured (i) to wrap around the product, (ii) to include adhesive to contact an outer surface of the packaging of the product, or (iii) to be inserted into an opening in the packaging of the product.

* * * * *